US005307646A

United States Patent [19]

Niblock

[11] Patent Number: 5,307,646

[45] Date of Patent: May 3, 1994

[54] FLAKE ICE MACHINE

[75] Inventor: Robert R. Niblock, Seattle, Wash.

[73] Assignee: North Star Ice Equipment Corporation, Seattle, Wash.

[21] Appl. No.: 720,227

[22] Filed: Jun. 25, 1991

[51] Int. Cl.[5] ..... F25C 1/14; F25C 1/00; A23G 9/00

[52] U.S. Cl. ..... 62/345; 62/347; 62/353; 62/59

[58] Field of Search ..... 62/135, 139, 345, 347, 62/353, 354, 59

[56] References Cited

U.S. PATENT DOCUMENTS

| | | | |
|---|---|---|---|
| 3,662,564 | 5/1972 | Clearman et al. | 62/320 |
| 4,185,467 | 1/1980 | Garland | 62/81 |
| 4,292,816 | 11/1981 | Gartzke | 62/347 X |
| 4,527,401 | 7/1985 | Nelson | 62/354 |
| 4,538,428 | 9/1985 | Wilkerson | 62/354 |

FOREIGN PATENT DOCUMENTS

| | | | |
|---|---|---|---|
| 0225956 | 9/1990 | Japan | 62/66 |

*Primary Examiner*—Henry A. Bennett

*Assistant Examiner*—C. Kilner

*Attorney, Agent, or Firm*—Christensen, O'Connor, Johnson & Kindness

[57] ABSTRACT

A flake ice machine (10) including a rotatable cooling member (12) defining cooling surfaces (20) and a plurality of internal refrigerant flow passages (76). The machine includes a spray tube (18) for introducing liquid material onto a portion of the cooling surfaces of the cooling member. A refrigerant supply system (30) supplies an excess of evaporative liquid refrigerant to the inlets (78) of the refrigerant flow passages, so that a portion of the liquid refrigerant evaporates within each passage to freeze the liquid material introduced onto the cooling surface, and a remaining portion of the refrigerant flows from the outlet (80) of each passage in the liquid state. Resilient removal blades (38) mounted adjacent each cooling surface remove frozen material from the cooling surface to form solid flakes of material. The flake ice machine further includes an automatic salinity control system (56, 58, 63) to automatically control the salinity of the liquid material being applied to the cooling surfaces of the cooling member.

16 Claims, 6 Drawing Sheets

FLAKE ICE MACHINE

FIELD OF THE INVENTION

The present invention relates to machines for freezing liquid material into solid form, and particularly, to a machine for producing flake ice.

BACKGROUND OF THE INVENTION

Machines that continuously and automatically produce large quantities of flake ice for use by the food processing industry, for cooling concrete in construction, and other uses are well known. A common type of conventional ice-making machine utilizes a stationary cylindrical drum that has an outer surface exposed to a coolant or a refrigerant and an inner surface onto which water is introduced. The water is frozen on the inner surface of the drum and removed by a rotating array of blades to form large flakes of ice. Such machines are capable of producing substantial quantities of ice, but are relatively large and expensive to construct.

Flake ice machines have also been developed that utilize a rotating cooling disk, rather than a drum, for more efficient production of ice. One such example is the disk machine disclosed in U.S. Pat. No. 3,863,462 to Treuer. A non-evaporative refrigerant flows through a pair of geometrically complex flow passages formed within the disk. Water is applied to a portion of the planar outside surfaces of the rotating disk, is subcooled, and is then removed by a series of radially spaced blades positioned adjacent the outer disk surfaces.

Other conventional rotating disk ice machines use a greater number of internal flow passages of generally equal length in an attempt to provide uniform cooling of the entire outer disk surface. Refrigerant flowing into the disk is channeled to provide each passage with a substantially equal amount of refrigerant. However, in practice it has been found that slight differences in the length of the passages, manufacturing variations in the cross-sectional dimensions of the passages, and varying refrigerant pressure losses associated with different passage contours results in an uneven degree of cooling from each passage.

Refrigeration circuits for conventional disk machines supply refrigerant to the disk at a flow rate that is limited to ensure that all refrigerant is evaporated within the disk. Substantially all refrigerant leaves the disk as a super-heated vapor. This type of construction and operation of a disk cooling system results in the most cooling-efficient flow passages within the disk not being fully utilized. The refrigerant flow rate must be restricted to a rate corresponding to the rate of evaporation within the passage with the least cooling capacity to ensure substantially all refrigerant is evaporated within that least efficient passage. But flow passages with more efficient rates of evaporation (i.e., that absorb more heat from the liquid material being frozen) are also limited to the flow rate corresponding to the less efficient passages, and thus are underfed refrigerant.

In addition to the capacity limitations of conventional ice-making machines, another drawback of conventional drum and disk machines is the variation in quality of the ice produced. In order to assure proper separation of the ice from the machine's cooling surfaces, to prevent the ice flakes from sticking together, and to produce ice flakes of a desirable large size, it is necessary to add a small quantity of salt to the water that is being frozen. Conventional machines rely on the manual addition of salt at periodic intervals to a water reservoir. This batchwise addition of salt results in a fluctuation of the salt concentration in the water, and inconsistent quality of the ice produced.

Additionally, the ice removal blades used in conventional machines of either the disk or drum type must be mounted spaced away from the machine's cooling surfaces to accommodate rotational run-out of the cooling member without causing the cooling surfaces to wear.

SUMMARY OF THE INVENTION

The present invention provides a flake ice machine with improved operational efficiency. The machine includes a cooling member that defines a plurality of internal refrigerant flow passages and a cooling surface, onto a portion of which liquid material is introduced. A refrigerant supply system supplies an excess of evaporative liquid refrigerant to the inlets of the passages so that a portion of the liquid refrigerant evaporates within each passage to freeze the liquid material introduced onto the cooling surface, and a remaining portion of the liquid refrigerant flows from the outlet of each passage in the liquid state. The machine further includes a removal tool for removing the frozen material from the cooling surface. The cooling member is mounted to rotate relative to the point of introduction of liquid material and the removal tool so that the cooling surface is cyclically exposed to liquid material introduction and frozen material removal.

The supply of excess evaporative refrigerant enables each passage, regardless of differences in cooling efficiencies, to operate at the fullest level of production possible, thus substantially increasing the overall production rate of frozen material from the machine.

In a preferred embodiment of the present invention, the cooling member is a rotatable disk and the material to be frozen is water containing a minute quantity of salt. The machine further includes an automated salinity control apparatus to control the concentration of salt in the water within a desired band to assure a uniformly high quality of ice produced. The salinity control mechanism includes a holding tank that contains water to be introduced to the cooling surface, a reservoir containing water saturated with the salt, and an automatic controller for regulating the flow of saturated water from the reservoir to the holding tank to adjust the salinity of the water in the holding tank.

In a further aspect of the present invention, frozen material is removed from the cooling surfaces of the disk by a blade mounted to position an edge of the blade adjacent the cooling surface of the cooling member, and enabling the edge of the blade to deflect away from this nominal position in response to variations in the cooling surface and the frozen material adhered to the cooling surface. In a preferred embodiment, the blade is constructed from a resilient material so that the blade flexes away from the cooling surface to pass over frozen material that is rigidly adhered to the cooling surface during initial startup of operation, or in response to rotational run-out of the cooling member. The resilient nature of the blade also permits the blade to nominally wipe the cooling surface to remove mineral deposits, without causing substantial wear of the cooling surface.

The refrigeration system of the present invention uses fewer components than refrigeration systems used in conventional flake ice machines. Thus, the flake ice machine is less expensive to construct and operate than conventional disk flake ice machines.

BRIEF DESCRIPTION OF THE DRAWINGS

The invention will presently be described in greater detail, by way of example, with reference to the accompanying drawings in which.

DETAILED DESCRIPTION OF THE PREFERRED EMBODIMENT

Figure 1:
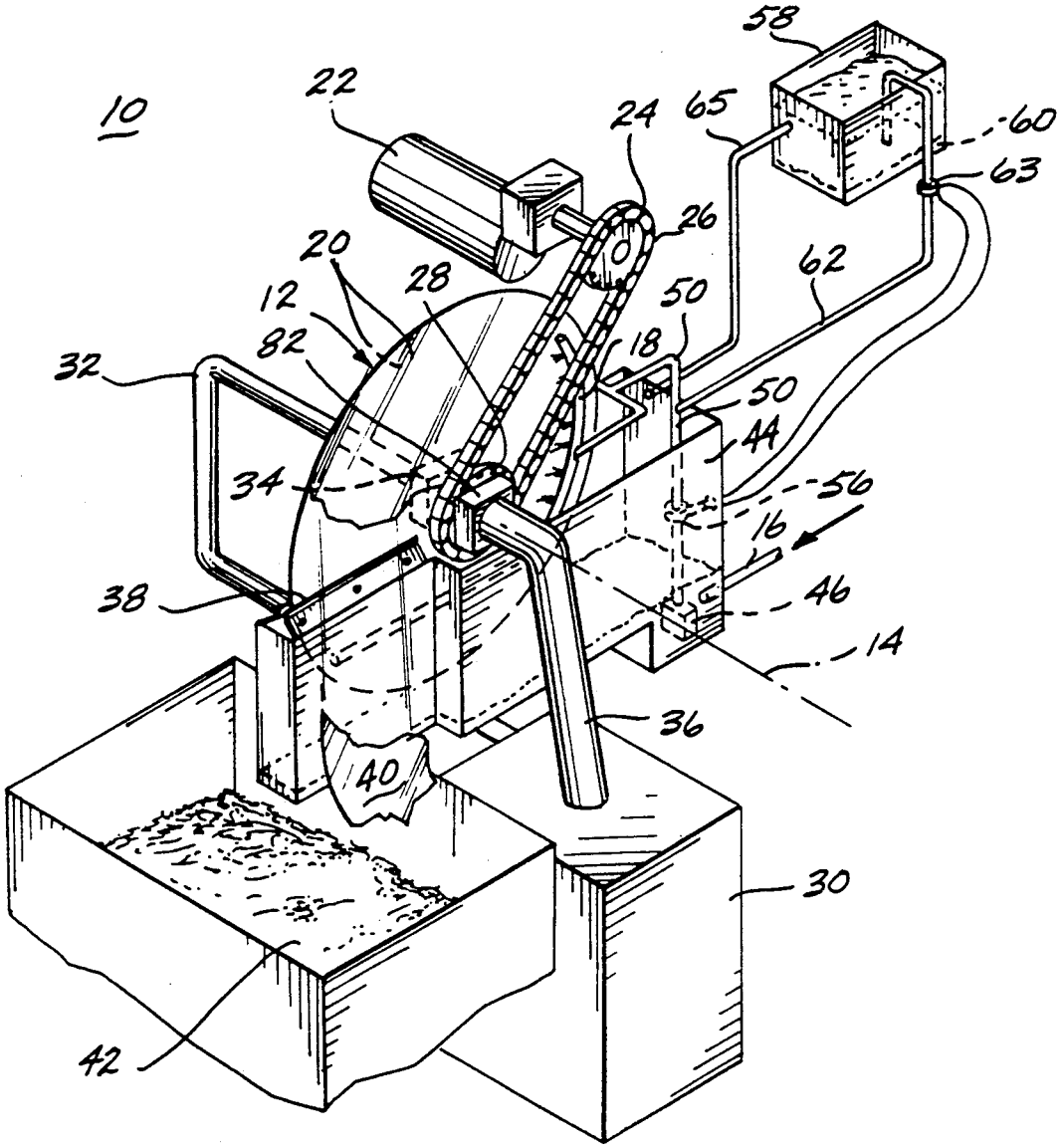
FIG. 1 provides a pictorial view of a flake ice machine constructed in accordance with the present invention.

A preferred embodiment of a flake ice machine 10 constructed in accordance with the present invention is shown in FIG. 1. A cooling member, such as a disk 12, is mounted on a central hub (not shown) to rotate about a central axis 14. A liquid material to be frozen, supplied from an inlet line 16, is introduced by a sprayer 18 to two cooling surfaces 20, defined by the circular sides of the disk 12. The disk is rotated by a motor 22 that drives a drive gear 24 coupled by a chain 26 to a driven gear 28 secured axially to the hub of the disk 12. An excess of liquid evaporative refrigerant is supplied by a refrigeration system 30 through an inlet line 32 connected at an intake manifold 34 to the hub of the disk 12. The refrigerant then flows through internal passages (not shown) formed within the disk 12, is partially evaporated to cool the cooling surfaces 20, and leaves the disk through an exhaust manifold (not shown) in fluid communication with a refrigerant return line 36.

Water is cyclically introduced to the cooling surfaces 20, frozen and removed as the disk 12 rotates past a pair of removal blades 38, mounted on either side of the disk adjacent the cooling surfaces 20. Ice falls from the disk in large flakes 40 and is collected in a bin 42.

The ice-making machine 10 is preferably operated on a continuous basis to maximize the production of ice flakes. Accordingly, operation of the machine will be described in this context, although it should be readily apparent that it would be possible to operate the machine on a discontinuous basis wherein the disk 12 rotates intermittently to build up a thicker layer of ice on the cooling surfaces 20.

A. Liquid Material Introduction

Figure 2:
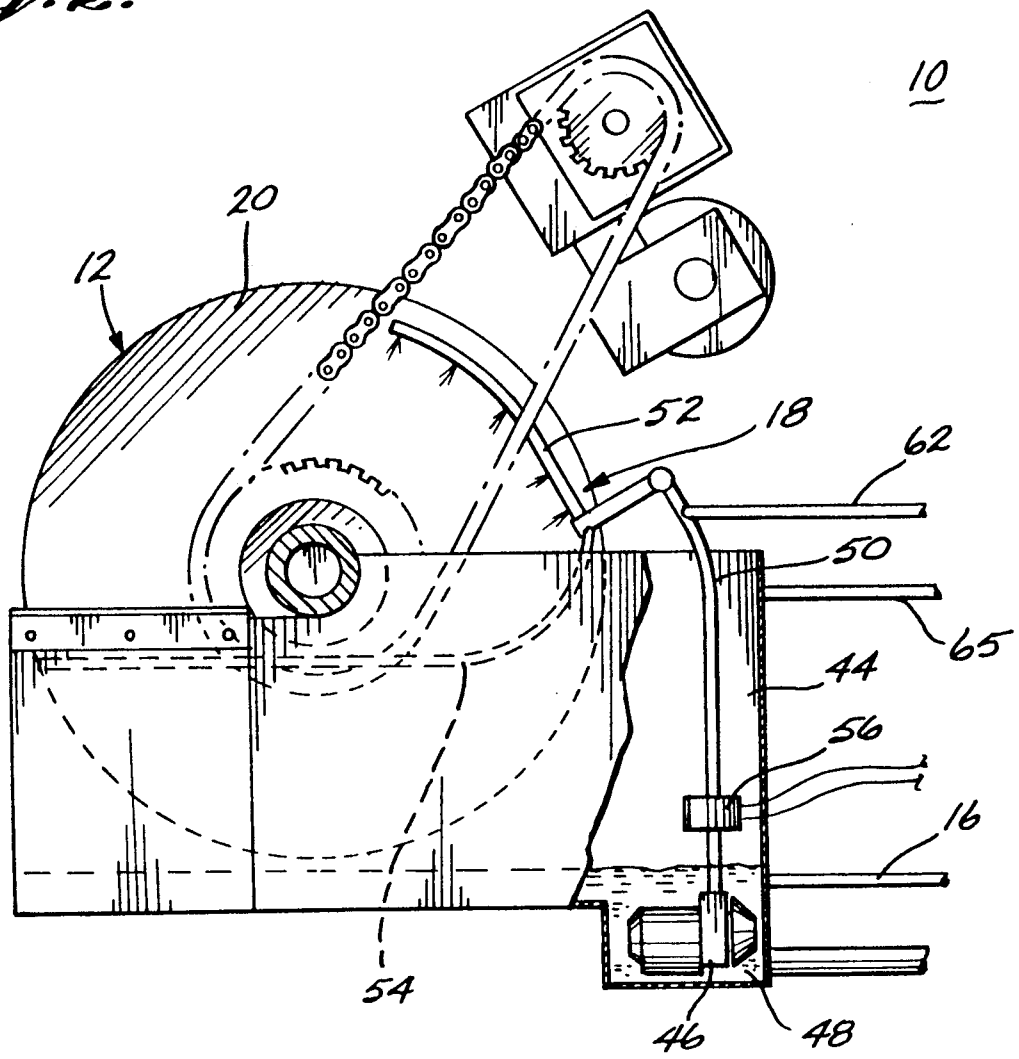
FIG. 2 provides a side elevational view of the disk, rotational mechanism, and water sprayer of the machine of FIG. 1.

Referring to FIGS. 1 and 2, water from the supply inlet 16 fills the bottom of a holding tank 44. A sump pump 46 disposed within a well 48 formed in the bottom of the tank pumps water through a discharge tube 50 that branches to supply first and second spray tubes 18 mounted adjacent either side of the disk 12. Referring to FIG. 2, the spray tubes include an upper section 52 and a lower section 54. The spray lines include spray outlets to spray water to at least a 180° wetted sector of the cooling surfaces 20, and preferably sprays water over at least a 225° sector, and more preferably to a 230° sector. Thus, each portion of the disk cooling surface 20 passes through introduction of water for a majority of the rotational cycle, allowing maximum use of the refrigerant flowing through the disk to build up a thick layer of ice. Excess water introduced to the cooling surfaces 20 drains into the bottom of the holding tank 44, where it is recirculated by the pump 46.

B. Salinity Control Mechanism

The flake ice machine 10 also includes a system for automatically controlling the salinity of the water that is introduced to the cooling surfaces. The salinity level is important to control the quality of the flake ice produced, and to cause the ice to release more readily from the cooling surfaces 20. Referring still to FIGS. 1 and 2, the automatic salinity control system includes a conductivity sensor 56 integrated into the discharge tube 50 downstream of the sump pump 46. The conductivity sensor 56 includes two electrodes that are in fluid communication with the water flowing through the tube 50. The conductivity sensor 56 generates a signal that is proportional to the salinity level of the water.

The salinity control system also includes a saturated salt reservoir 58 that contains water and a layer of solid salt 60, such as sodium chloride, so that the water becomes saturated with the salt. Salt is added to the reservoir 58 infrequently to ensure that salt water within the reservoir remains saturated. A reservoir supply line 62 diverts water from the water discharge tube 50 to the reservoir 58. An electrically operated valve 63 within the reservoir supply line 62 controls the flow of water from the holding tank 44 into the reservoir 58. A two-stage electronic controller (not shown) connected to the conductivity sensor 56 and valve 63 opens and closes the valve 63 in response to the signal from the sensor 56. Introduction of water into the reservoir 58 results in gravity flow of saturated water from the reservoir, through a return line 65, into the holding tank 44 to raise the salinity level of the water stored in the holding tank 44.

The electronic controller is operable in either a high or low salinity level cycle. Upon initial operation of the ice-making machine, valve 63 is controlled to flow a large quantity of salt-saturated water into the holding tank 44, raising the salinity of water introduced to the disk 12 to a high level, such as on the order of 1,000 parts per million. This high initial level is needed because the first ice that forms on the cooling surfaces 20 is very difficult to remove from the cooling surfaces. The higher salt level makes the ice separate more easily. Once this high level is obtained, the controller automatically shifts to a low-level operation wherein no salt is added to the holding tank 44 until the salinity of the water within the holding tank has dropped to within a normal operating range.

Conventional ice-making machines relying on the manual batch addition of salt to the water supply operate with a salinity level somewhere between 250 and 500 parts per million. However, it has been found that the present invention allows the normal operating salinity level to be closely controlled to between 150 and 250 parts per million, and more ideally to between 150 to 200 parts per million. This narrower range of salinity provides a more uniform consistency in the ice produced, and also reduces the amount of salt consumed. While the present invention operates well with the addition of sodium chloride, other mineral salts could alternatively be added to the water supply of a machine constructed in accordance with the present invention.

C. Ice Removal Blades

Figure 3:
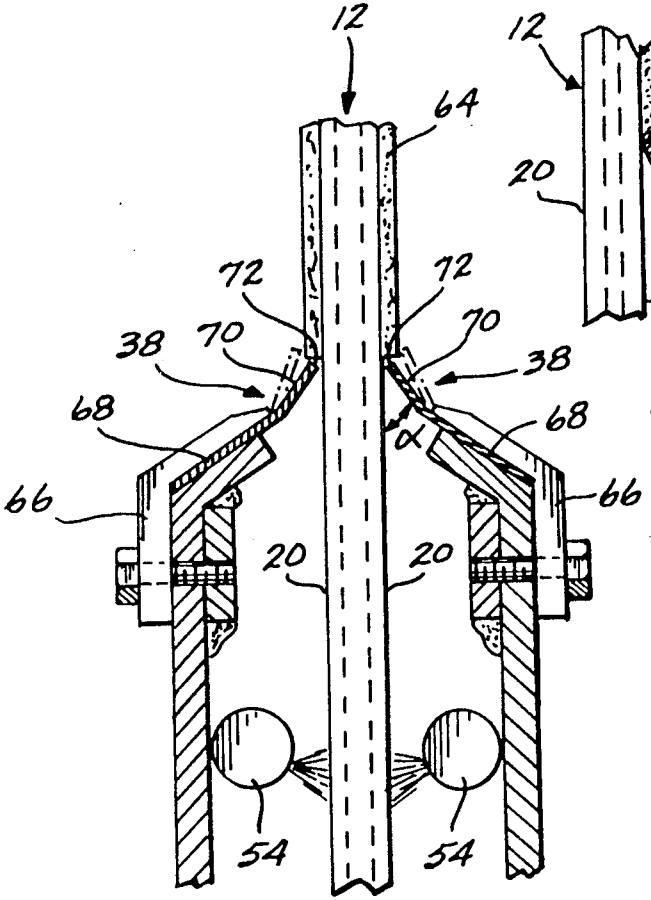
FIG. 3 provides an enlarged partial endwise view of the ice removal blades of the machine of FIG. 1.

Reference is now had to FIGS. 1 and 3 to describe the construction and operation of the ice removal blades 38. After water is introduced to the cooling surfaces 20, the ice layer 64 formed passes through a subcooling portion of the rotational cycle. During this period of the rotational cycle, the ice is cooled below freezing, shrinks, and loosens from the cooling surfaces 20. Large ice flakes 40 are then caused to break away from the loosened ice layer 64 by the removal blades 38. Referring to FIG. 3, the removal blades 38 are mounted in a clamp assembly 66 located adjacent each side of the disk 12. Ideally the blades are formed from an elongated sheet of resilient material, such as tempered steel. Each removal blade 38 is bent to form an elongated base portion 68 that is clamped by the clamp assembly 66, and an elongated tip portion 70 that is angled relative to the base portion 68. As shown in FIG. 3, the inner edge 72 of the tip portion 70 is nominally positioned in contact with the adjacent cooling surface 20 of the disk 12. The blades 38 are configured and mounted within the clamp assembly 66 so that the plane of the blade tip portion 70 intersects the plane of the cooling surface 20 at an angle $\alpha$ of 45° or less, and preferably less than or equal to 30°, relative to the plane of the cooling surface 20.

In normal operation, the edge 72 of each blade 38 nominally lightly wipes the cooling surface 20 to remove any mineral deposits left by the frozen water. The blades 38 have enough resilience and flexibility to prevent excessive wear of the cooling surface 20 or the blade 38. Occasionally, the ice layer 64 on the disk surfaces 20 may be rigidly adhered to the cooling surfaces 20, such as during the initial start up of the disk. When this occurs, the tip portions 70 of the blades 38 flex to the position shown in dashed line in FIG. 3 to deflect the edges 72 away from the cooling surface. The edges 72 of the blades then rides over the rigidly adhered layer of ice until the ice is loosened, whereupon the blades return to their nominal positions. The resilient flexing of the blades 38 also accommodates any irregularities in rotational run-out of the disk 12, reducing the need for careful tolerancing and machining of the disk 12.

D. Refrigeration System

Figure 5:
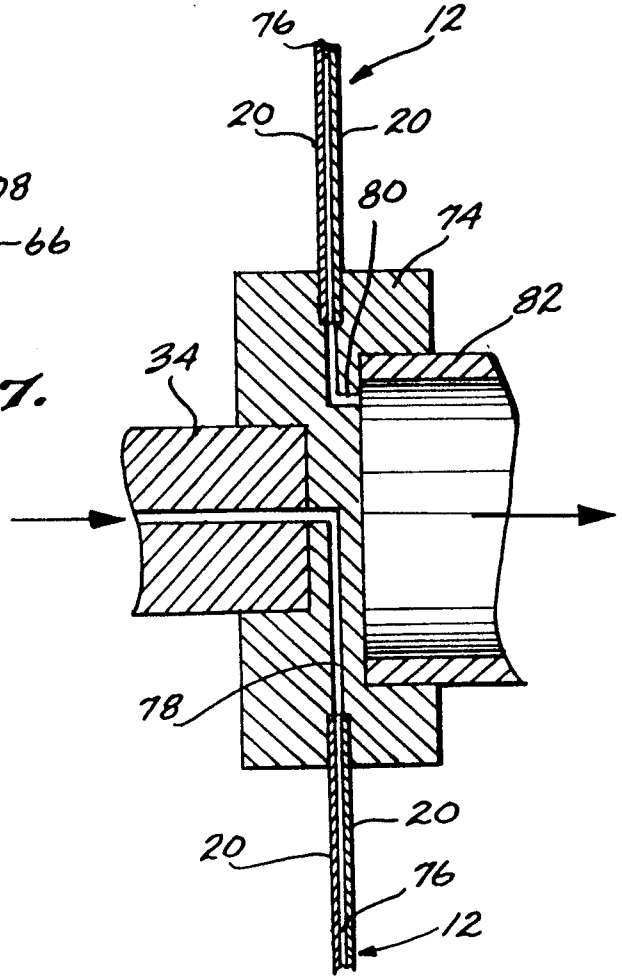
FIG. 5 presents a partial, cross-sectional view of the hub of the cooling disk of the machine of FIG. 1.
Figure 4:
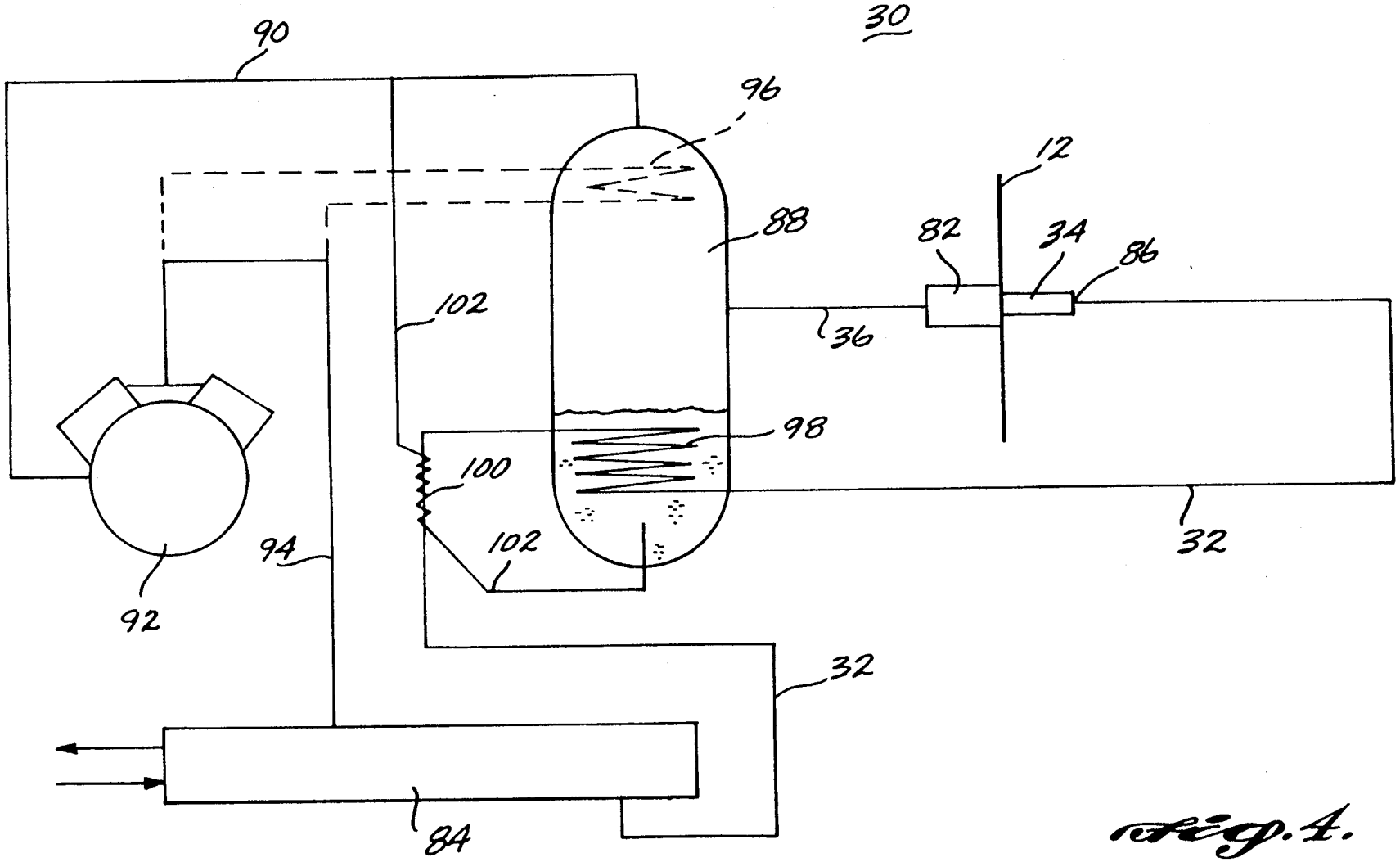
FIG. 4 provides a schematic diagram of the refrigeration system of the machine of FIG. 1.

Reference is now had to FIGS. 4 and 5 to describe the construction and operation of the refrigeration system 30. Referring initially to FIG. 5, the disk 12 is mounted on a hub 74, and serves as the system evaporator. The disk includes a plurality of internal refrigerant flow passages 76 that are formed within the disk by conventional methods. Typically, the disk 12 is constructed from first and second mating disk plates. Internal flow channels may be formed in one disk plate, which is mated with a second flat plate. Alternatively, mirror-imaged channels can be machined or otherwise formed in both plates, which are then mated to form the passages. An additional example of conventional disk construction is the forming of passages by welding or otherwise forming baffles on a first flat plate and mating that with a second flat plate. Typically the internal flow passages produced by any of the above methods trace geometrically complex paths so as to be of substantially equal length and cover the majority of the area of the disk plates.

Refrigerant is supplied to the disk through the intake manifold 34, where it flows into an inlet port 78 that is machined or otherwise formed within the hub 74. The inlet port 78 branches within the disk to form the plurality of flow passages 76. Liquid refrigerant flows through each of the passages 76, wherein it is partially evaporated as the disk cooling surface 20 is cooled. The partially evaporated refrigerant and excess liquid refrigerant exits the flow passages 76, converges, and flows from the hub 74 through an outlet port 80 formed therein, and then through an exhaust manifold 82.

The refrigeration system 30 is shown in schematic form in FIG. 4. An important aspect of the present invention is the supply of excess refrigerant to the cooling disk 12. The evaporative refrigerant, such as freon, ammonia, or other refrigerant, is supplied at a flow rate such that only a portion of the refrigerant exiting each flow passage 76 is evaporated. This assures that there is ample refrigerant to utilize the full cooling capacity of each refrigerant flow passage, regardless of the efficiency of that passage. The flow rate of liquid refrigerant to the disk is preferably between greater than 0% and less than about 50% above the flow rate at which all refrigerant would be completely evaporated within the flow passage 76 having the highest cooling efficiency, i.e., the flow passage 76 in which the highest quantity of refrigerant evaporates. Preferably, the refrigerant is introduced to the disk at a rate of between about 10% and about 50% above the rate at which all the refrigerant would be evaporated within the highest efficiency passage 76. In practice, a flow rate of about 20% above the rate at which all refrigerant would be evaporated within the highest efficiency passages has been found to be very effective.

Referring to FIG. 4, high pressure, subcooled liquid refrigerant from a condenser 84 flows through the inlet line 32 and passes through an expansion orifice 86 mounted within the intake manifold 34. The expansion orifice 86 has a fixed diameter that is predetermined for the intended operating conditions of the flake ice machine 10. The size of the expansion orifice 86 is primarily determined by the temperature of water supplied through the water inlet 16 to the flake ice machine. The flake ice machine 10 can be altered for different operating conditions by replacing the expansion orifice 86 with an expansion orifice of a different diameter; however, once a particular orifice is installed, it operates in an invarying manner. This is in contrast to conventional flake ice machines, which use a more expensive expansion valve that must be adjusted during operation.

Refrigerant flowing through the expansion orifice 86 then flows through the intake manifold 34 into the internal flow passages 76. The partially evaporated refrigerant exiting each flow passage 76 then passes through the exhaust manifold 82, through a refrigerant return line 36, and to a low pressure receiver 88. The low pressure receiver is used in place of the conventional combination of a high pressure receiver, installed between the condenser and the disk evaporator, and a separate accumulator installed after the disk evaporator. Unevaporated liquid refrigerant from the disk 12, which has not lost all of its cooling potential, is collected in the bottom of the low pressure receiver 88, and evaporated refrigerant is drawn from the receiver 88 by a suction line 90 leading to an oil lubricated compressor 92. Compressed, super-heated gaseous refrigerant then flows from the compressor 92 back to the condenser 84 via a line 94. Optionally, compressed super-heated refrigerant leaving the compressor 92 may flow through a "de-superheater" heat exchanger 96 that places the compressed refrigerant in thermal communication with the evaporated refrigerant within the low pressure receiver 88.

Warm, condensed refrigerant leaving the condenser 84 via refrigerant inlet line 32 passes through a heat exchanger 98 that places the condensed refrigerant in thermal communication with the unevaporated, low pressure refrigerant contained within the receiver 88. The heat exchanger 98 results in the subcooling of the condensed refrigerant flowing through line 32, and the further evaporation of refrigerant within the low pressure receiver 88.

In a further unique aspect of the present invention, the refrigerant system 30 includes an automatic refrigerant/oil heat exchanger-separator 100 for returning lubricating oil lost from the compressor 92 to the compressed refrigerant. This lost lubricating oil flows through the refrigerant system from the compressor 92, and is collected within the receiver 88 as a mixture of oil and unevaporated refrigerant. The mixture of oil and unevaporated refrigerant is drawn from the low pressure receiver 88 through an oil return line 102 to the heat exchanger-separator 100. The heat exchanger-separator 100 places the refrigerant/oil mixture in thermal communication with the warmer condensed refrigerant leaving the condenser 84 via the inlet line 32. Heat absorbed from the warmer condensed refrigerant causes evaporation of some of the liquid refrigerant within the refrigerant/oil mixture, which forces the oil to be carried upwardly by a percolating action to the compressor suction line 90. A suitable refrigerant/oil heat exchanger-separator is sold by Superior Valve Co. of Washington, Pa. 15301.

An ice machine 10 constructed in accordance with the present invention is capable of producing approximately two metric tons of ice per day through the use of a single 24" in diameter disk and an inlet water supply of 60° F. This production rate is substantially higher than that obtainable through the use of conventional flake ice machines. Even higher production rates can be obtained through the use of multiple cooling disks, as shall be described subsequently, larger cooling disks, or the introduction of a colder water supply.

Figure 6:
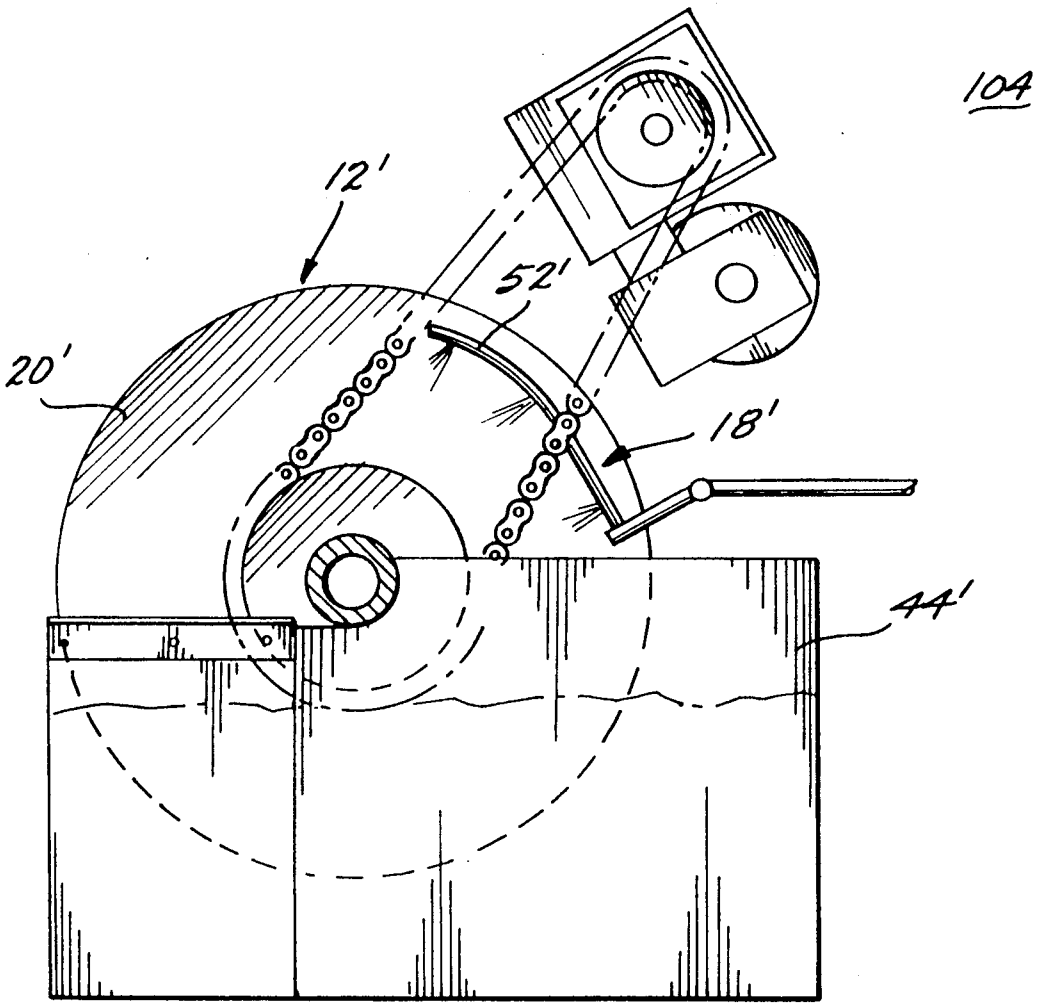
FIG. 6 provides a side elevational view of an alternate embodiment of a flake ice machine constructed in accordance with the present invention in which water is introduced from both a sprayer and an immersion tank.

One of ordinary skill in the art will recognize that various alterations and modifications may be made in accordance with the present invention to the ice-making machine 10. For instance, FIG. 6 illustrates an alternate embodiment of a flake ice machine 104. The flake ice machine 104 is identical in construction to the flake ice machine 10, with the exception of the manner in which water is introduced to the disk cooling surfaces. Similarly configured parts are therefore indicated using the same part numbers but with the addition of a prime(') designation. The machine 104 includes a spray tube 18' having only an upper spray section 52' mounted adjacent each side of a disk 12'. A first portion of the wetted sector of a disk 12' is wetted by the spray tube 18', with water sprayed by the spray tube 18' running downwardly over cooling surfaces 20' into a tank 44'. The tank 44' is substantially filled with water to wet the remaining portion of the wetted sector of the disk by immersion. The combination of spraying and immersion wets the surfaces 20' of the disk 12' to the same extent as in the flake ice machine 10, and either configuration is suitable for use in most applications. However, a sprayer alone, as used in the ice machine 10, is preferably for use on board ships, since pitching and rolling of the ship would cause spillage from the immersion tank.

Figure 7:
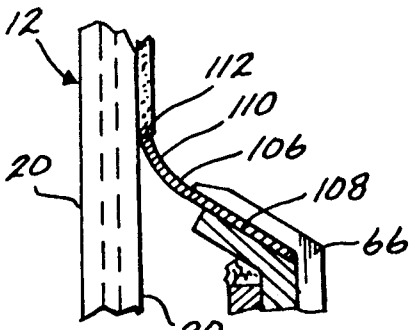
FIG. 7 provides a partial, cross-sectional view of an alternate configuration for an ice removal tool constructed in accordance with the present invention.

A further variation to the disk ice-making machine 10 is the substitution of arcuate-shaped removal blades 106 (as shown in FIG. 7) in place of the removal blades 38'. The arcuate blades 106 are similarly configured to the removal blades 38, with the exception that the blade 106 curves continuously from a base portion 108, held by the clamp assembly 66, to a tip portion 110 adjacent the cooling surface 20 of the disk 12. This curvature of the blade 106 causes the tip portion 110 to define an acute angle with the disk surface 20 of between a maximum of 30° and approaching 0°. The curvature of the blade 106 allows the blade to flex more easily to deflect the edge 112 away from the disk surface 20 in response to variations in the disk surface or rigidly adhered, frozen material.

Although the ice-making machine 10 has thus far been described as using resiliently flexible blades 38 or 106, it should be apparent that rigid blades secured in position by a resilient fixture could be used instead. For instance, spring biased holders could be used to position stiff blades against the disk, with the springs allowing the edge of the blade to deflect away from the disk in response to disk surface variations, and then urging the blade to return back to a position wiping the coolant surfaces of the disk.

Figure 8:
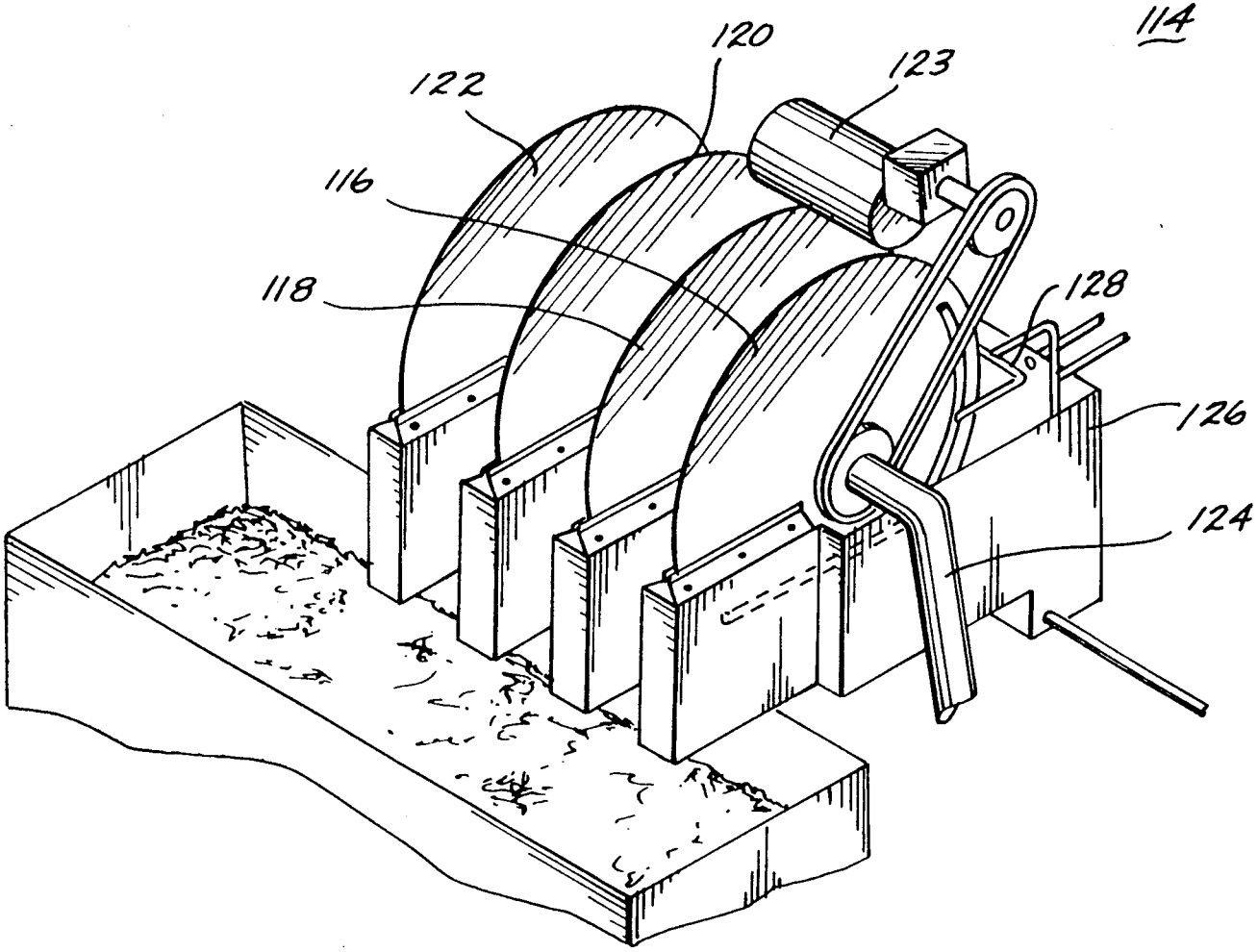
FIG. 8 provides a pictorial view of an alternate embodiment of the present invention constructed with multiple cooling disks.

As a further example of a variation of an ice machine constructed in accordance with the present invention, a flake ice-making machine may be constructed that uses more than one cooling disk. FIG. 8 shown an alternate embodiment of a multiple disk machine 114 that includes four disks 116, 118, 120 and 122, mounted on a central shaft assembly (not shown) for simultaneous rotation by a single motor 123. The refrigerant system supplies an excess flow rate of refrigerant to each of the four disks via an inlet line 124. Water is supplied from a single large holding tank 126 to individual spray tubes 128 to introduce water to each disk. Other configurations of multi-disk machines can be similarly constructed in accordance with the present invention, such as machines utilizing two, three, or five disks.

Although the present invention has been described in the context of a disk flake ice machine, the principles of the present invention may be applied to other types of flake ice machines. For example, rather than a rotating disk, the flake ice machine could be constructed utilizing a rotating cylindrical drum. Excess refrigerant would be supplied to cool the drum to realize the same increase in efficiency of ice production. Similarly, the automatic salinity control mechanism and resilient blades of the present invention could be utilized in such a system.

The flake ice machine constructed in accordance with the present invention may also be utilized to produce frozen flakes from liquid material other than water. For instance, the flake ice machine 10 of the present invention could be adapted for use in freezing orange juice concentrate and in other food industry processes. As a further example, a flake ice machine constructed in accordance with the present invention could be utilized to freeze human blood products.

One of ordinary skill after reading the foregoing specification may be able to effect various other changes, alterations and substitutions of equivalents without departing from the broad concepts disclosed. It is therefore intended that the scope of letter patent granted hereon be limited only by the definitions contained in the appended claims and the equivalents thereof.

The embodiments of the invention in which an exclusive property or privilege is claimed are defined as follows:

1. An apparatus for freezing a liquid material to produce substantially solid flakes of material, comprising:

a cooling member defining a cooling surface and a plurality of internal refrigerant flow passages, each passage defining an inlet and an outlet;

liquid introduction means for introducing liquid material onto a portion of the cooling surface;

a refrigerant supply system for supplying an excess of evaporative liquid refrigerant to the inlets of the passages so that a portion of the liquid refrigerant evaporates within each passage to freeze the liquid material introduced onto the cooling surface, and a remaining portion of the liquid refrigerant flows from the outlet of each passage in the liquid state;

a low pressure receiver for receiving evaporated and liquid refrigerant flowing from the outlets of the passages, the liquid refrigerant received within the low pressure receiver thermally communicating with, and thereby cooling, a high pressure inlet stream of liquid refrigerant being supplied to the inlets of the passages;

an oil lubricated compressor for drawing evaporated refrigerant from the low pressure receiver and compressing such evaporated refrigerant;

oil reclaiming means for reclaiming lubricating oil lost to the refrigerant while being compressed by the compressor, the oil reclaiming means drawing a mixture of oil and liquid refrigerant from the low pressure receiver through an oil return line in thermal communication with the high pressure inlet stream of refrigerant to evaporate the liquid refrigerant in the mixture of oil and liquid refrigerant sufficiently to force the oil in the mixture back to the compressor by a percolating action;

removal means for removing the frozen material from the cooling surface; and means for mounting the cooling member, liquid introduction means and removal means to rotate the cooling member relative to the liquid introduction means and removal means, so that the cooling surface is cyclically exposed to the liquid introduction means and then the removal means.

2. An apparatus for freezing a liquid material to produce substantially solid flakes of material, comprising:

a cooling member defining a cooling surface and a plurality of internal refrigerant flow passages, each passage defining an inlet and an outlet, wherein the cooling member comprises a rotatable disk;

liquid introduction means for introducing liquid material onto a portion of the cooling surface, wherein the liquid introduction means introduces liquid material to at least a 225° wetted sector of the cooling surface;

refrigerant supply means for supplying an excess of evaporative liquid refrigerant to the inlets of the passages whereby a portion of the liquid refrigerant evaporates within each passage to freeze the liquid material introduced onto the cooling surface, and a remaining portion of the liquid refrigerant flows from the outlet of each passage in the liquid state;

receiver means for receiving evaporated and liquid refrigerant from the outlets of the cooling member flow passages;

removal means for removing the frozen material from the cooling surface; and means for mounting the cooling member, liquid introduction means and removal means to rotate the cooling member relative to the liquid introduction means and removal means, so that the cooling surface is cyclically exposed to the liquid introduction means and then the removal means.

3. The apparatus of claim 2, wherein the liquid introduction means comprises a spray means for spraying liquid material onto the wetted sector of the cooling surface.

4. The apparatus of claim 2, wherein the liquid introduction means comprises:

a sprayer for spraying liquid material onto a first portion of the wetted sector of the cooling surface; and an immersion tank containing liquid material for wetting a second portion of the wetted sector of the cooling surface.

5. An apparatus for freezing a liquid material to produce substantially solid flakes of material, comprising:

a cooling member defining a cooling surface and a plurality of internal refrigerant flow passages, each passage defining an inlet and an outlet;

liquid introduction means for introducing liquid material onto a portion of the cooling surface;

refrigerant supply means for supplying an excess of evaporative liquid to the inlets of the passages whereby a portion of the liquid refrigerant evaporates within each passage to freeze the liquid material introduced onto the cooling surface, and a remaining portion of the liquid refrigerant flows from the outlet of each passage in the liquid state;

receiver means for receiving evaporated and liquid refrigerant from the outlets of the cooling member flow passages;

removal means for removing the frozen material from the cooling surface;

means for mounting the cooling member, liquid introduction means and removal means to rotate the cooling member relative to the liquid introduction means and removal means, so that the cooling surface is cyclically exposed to the liquid introduction means and then the removal means; and salinity control means for automatically controlling the salinity of the liquid material by regulating the introduction of a salt to the liquid material before the liquid material is introduced to the cooling surface.

6. An apparatus for freezing a liquid material to produce substantially solid flakes of material, comprising:

a cooling member defining a cooling surface and a plurality of internal refrigerant flow passages, each passage defining an inlet and an outlet;

liquid introduction means for introducing liquid material onto a portion of the cooling surface;

a refrigerant supply system for supplying an excess of evaporative liquid refrigerant to the inlets of the passages so that a portion of the liquid refrigerant evaporates within each passage to freeze the liquid material introduced onto the cooling surface, and a remaining portion of the liquid refrigerant flows from the outlet of each passage in the liquid state;

receiver means for receiving evaporated and liquid refrigerant from the outlets of the cooling member flow passages;

removal means for removing the frozen material from the cooling surface;

means for mounting the cooling member, liquid introduction means and removal means to rotate the cooling member relative to the liquid introduction means and removal means, so that the cooling surface is cyclically exposed to the liquid introduction means and then the removal means; and salinity control means for automatically controlling the salinity of the liquid material by regulating the introduction of a salt to the liquid material before the liquid material is introduced to the cooling surface, wherein the salinity control means comprises:

a holding tank containing liquid material to be introduced to the cooling surface;

a reservoir containing liquid material saturated with the salt; and means for automatically regulating the flow of saturated liquid material from the reservoir to the holding tank to adjust the salinity of the liquid material in the holding tank.

7. The apparatus of claim 6, wherein the means for automatically regulating the flow of saturated liquid material comprises:

a conductivity sensor for sensing the electrical conductivity of the liquid material in the holding tank; and a valve operative in response to the conductivity sensor for starting and stopping flow of saturated liquid from the reservoir to the holding tank.

8. The apparatus of claim 5, wherein the salinity control means controls the salinity of the liquid material to about between 150 and 250 parts per million of salt.

9. An apparatus for freezing a liquid material to produce substantially solid flakes of material, comprising:

a cooling member defining a cooling surface and a plurality of internal refrigerant flow passages, each passage defining an inlet and an outlet, wherein the cooling member comprises a rotatable disk;

liquid introduction means for introducing liquid material onto a portion of the cooling surface, refrigerant supply means for supplying an excess of evaporative liquid refrigerant to the inlets of the passages whereby a portion of the liquid refrigerant evaporates within each passage to freeze the liquid material introduced onto the cooling surface, and a remaining portion of the liquid refrigerant flows from the outlet of each passage in the liquid state;

receiver means for receiving evaporated and liquid refrigerant from the outlets of the cooling member flow passages;

removal means for removing the frozen material from the cooling surface, wherein the removal means comprises:

at least one removal blade;

mounting means for mounting the removal blade to nominally position an edge of the blade adjacent the cooling surface for removal of frozen material, the mounting means also enabling deflection of the edge of the blade away from nominal position in response to variations in the cooling surface and the frozen material adhered to the cooling surface; and means for mounting the cooling member, liquid introduction means and removal means to rotate the cooling member relative to the liquid introduction means and removal means, so that the cooling surface is cyclically exposed to the liquid introduction means and then the removal means.

10. An apparatus for freezing a liquid material to produce substantially solid flakes of material, comprising:

a cooling member defining a cooling surface and a plurality of internal refrigerant flow passages, each passage defining an inlet and an outlet;

liquid introduction means for introducing liquid material onto a portion of the cooling surface;

a refrigerant supply system for supplying an excess of evaporative liquid refrigerant to the inlets of the passages so that a portion of the liquid refrigerant evaporates within each passage to freeze the liquid material introduced onto the cooling surface, and a remaining portion of the liquid refrigerant flows from the outlet of each passage in the liquid state;

a receiver for receiving evaporated and liquid refrigerant from the outlets of the cooling member flow passages;

removal means for removing the frozen material from the cooling system, wherein the removal means comprises at least one resilient removal blade and mounting means for mounting the removal blade, the mounting means nominally positioning an edge of the resilient blade adjacent the cooling surface for removal of frozen material, the resilient blade resiliently flexible whereby the edge is deflected away from its nominal position, in response to variations in the cooling surface and the frozen material adhered to the cooling surface, and then returned to the nominal position; and means for mounting the cooling member, liquid introduction means and removal means to rotate the cooling member relative to the liquid introduction means and removal means, so that the cooling surface is cyclically exposed to the liquid introduction means and then the removal means.

11. The apparatus of claim 10, wherein the resilient blade is contoured so that the edge of the blade is disposed at an angle of 45° or less with respect to the cooling surface.

12. The apparatus of claim 11, wherein the edge of the resilient blade nominally contacts the cooling surface.

13. An apparatus for freezing a liquid material to produce substantially solid flakes of material, comprising:

a cooling member defining a cooling surface and a plurality of internal refrigerant flow passages, each passage defining an inlet and an outlet;

liquid introduction means for introducing liquid material onto a portion of the cooling surface;

a refrigerant supply system for supplying an excess of evaporative liquid refrigerant to the inlets of the passages so that a portion of the liquid refrigerant evaporates within each passage to freeze the liquid material introduced onto the cooling surface, and a remaining portion of the liquid refrigerant flows from the outlet of each passage in the liquid state;

a receiver for receiving evaporated and liquid refrigerant from the outlets of the cooling member flow passages;

removal means for removing the frozen material from the cooling surface, wherein the removal means comprises:

at least one removal blade;

mounting means for mounting the removal blade to nominally position an edge of the blade adjacent the cooling surface for removal of frozen material, the mounting means also enabling deflection of the edge of the blade away from nominal position in response to variations in the cooling surface and the frozen material adhered to the cooling surface wherein the edge of the removal blade is disposed at an angle of 45° or less with respect to the cooling surface; and means for mounting the cooling member, liquid introduction means and removal means to rotate the cooling member relative to the liquid introduction means and removal means, so that the cooling surface is cyclically exposed to the liquid introduction means and then the removal means.

14. The apparatus of claim 13, wherein the edge of the removal blade is disposed at an angle of 30° or less with respect to the cooling surface.

15. A method for freezing a liquid material to produce substantially solid flakes of material, comprising:

introducing liquid material from a liquid material supply onto a portion of a cooling surface defined by a cooling member having a plurality of internal refrigerant flow passages, each passage defining an inlet port and an outlet port;

supplying an excess of evaporative liquid refrigerant to the inlet ports of the passages so that a portion of the liquid refrigerant evaporates within each passage to freeze the liquid material introduced to the cooling surface and a remaining portion of the liquid refrigerant flows from the outlet port of each passage in the liquid state;

receiving evaporated and liquid refrigerant from the outlet ports of the flow passages;

removing frozen material with a removal tool from the cooling surface of the cooling member; and rotating the cooling member relative to the liquid material supply and removal tool, so that the cooling surface is cyclically exposed to liquid material introduction and then removal of the frozen material, further comprising the step of automatically controlling the salinity of the liquid material by regulating the introduction of a salt to the liquid material before the liquid material is introduced to the cooling surface of the cooling member.

16. A method for freezing a liquid material to produce substantially solid flakes of material, comprising:

introducing liquid material from a liquid material supply onto a portion of a cooling surface defined by a cooling member having a plurality of internal refrigerant flow passages, each passage defining an inlet port and an outlet port;

supplying an excess of evaporative liquid refrigerant to the inlet ports of the passages so that a portion of the liquid refrigerant evaporates within each passage to freeze the liquid material introduced to the cooling surface and a remaining portion of the liquid refrigerant flows from the outlet port of each passage in the liquid state;

receiving evaporated and liquid refrigerant from the outlet ports of the flow passages;

removing frozen material with a removal tool from the cooling surface of the cooling member; and rotating the cooling member relative to the liquid material supply and removal tool, so that the cooling surface is cyclically exposed to liquid material introduction and then removal of the frozen material, wherein the step of removing frozen material from the cooling surface of the cooling member includes the mounting of a resilient removal blade so that an edge of the blade is nominally positioned adjacent the cooling surface for removal of frozen material, the blade being resiliently flexible to deflect the edge of the blade away from the nominal position in response to variations in the cooling surface and frozen material adhered to the cooling surface.

* * * * *

UNITED STATES PATENT AND TRADEMARK OFFICE

CERTIFICATE OF CORRECTION

PATENT NO. : 5,307,646

DATED : May 3, 1994

INVENTOR(S) : R.R. Niblock

It is certified that error appears in the above-indentified patent and that said Letters Patent is hereby corrected as shown below:

| COLUMN | LINE | |
|---|---|---|
| [56] Pg. 1, col. 1 | Refs. Cited U.S. Pat. Docs. | Insert --171,267 12/1875 Cook-- |
| [56] Pg. 1, col. 1 | Refs. Cited U.S. Pat. Docs. | Insert --518,618 04/1894 Mendes-- |
| [56] Pg. 1, col. 1 | Refs. Cited U.S. Pat. Docs. | Insert --2,054,841 09/1936 Taylor ..... 62/106-- |
| [56] Pg. 1, col. 1 | Refs. Cited U.S. Pat. Docs. | Insert --2,659,212 11/1953 Lees ..... 62/106-- |
| [56] Pg. 1, col. 1 | Refs. Cited U.S. Pat. Docs. | Insert --2,735,275 02/1951 Branchflower ..... 62/107-- |
| [56] Pg. 1, col. 1 | Refs. Cited U.S. Pat. Docs. | Insert --3,159,986 12/1964 King ..... 62/354-- |
| [56] Pg. 1, col. 1 | Refs. Cited U.S. Pat. Docs. | Insert --3,863,462 02/1975 Treuer ..... 62/345-- |
| [56] Pg. 1, col. 1 | Refs. Cited U.S. Pat. Docs. | Insert --4,420,949 12/1983 Bartholmey et al ..... 62/354-- |

UNITED STATES PATENT AND TRADEMARK OFFICE

CERTIFICATE OF CORRECTION

PATENT NO. : 5,307,646

DATED : May 3, 1994

INVENTOR(S) : R.R. Niblock

It is certified that error appears in the above-indentified patent and that said Letters Patent is hereby corrected as shown below:

| COLUMN | LINE | |
|---|---|---|
| [56] Pg. 1, col. 1 | Refs. Cited For. Pat. Docs. | Insert --408032 3/1910 France-- |
| [56] Pg. 1, col. 1 | Refs. Cited For. Pat. Docs. | Insert --1460095 12/1976 Great Britain-- |
| [56] Pg. 1, col. 1 | Refs. Cited For. Pat. Docs. | Insert --1502607 03/1978 Great Britain-- |
| [56] Pg. 1, col. 1 | Refs. Cited For. Pat. Docs. | Insert --3300013 07/1984 West Germany-- |
| [56] Pg. 1, col. 1 | Refs. Cited For. Pat. Docs. | Insert --85/03996 09/1985 PCT-- |
| [56] Pg. 1, col. 1 | Refs. Cited For. Pat. Docs. | Insert --89/01120 09/1989 PCT-- |
| 8 | 34 | "shown" should read --shows-- |
| 10 (Claim 5, | 32 line 9) | "evaporative liquid to" should read --evaporative liquid refrigerant to-- |

UNITED STATES PATENT AND TRADEMARK OFFICE

CERTIFICATE OF CORRECTION

PATENT NO. : 5,307,646
DATED : May 3, 1994
INVENTOR(S) : R. R. Niblock

It is certified that error appears in the above-indentified patent and that said Letters Patent is hereby corrected as shown below:

| Column | Line | |
|---|---|---|
| 10<br>(Claim 5, line 9) | 32 | "evaporative liquid to" should read --refrigerant to--. |

Signed and Sealed this

Twenty-eight Day of March, 1995

*Attest:*

Bruce Lehman

BRUCE LEHMAN

*Attesting Officer*

*Commissioner of Patents and Trademarks*